US007738800B2

(12) United States Patent
Yamada

(10) Patent No.: US 7,738,800 B2
(45) Date of Patent: Jun. 15, 2010

(54) PRINTING DEVICE HAVING PLURAL PRINT DENSITY RANGE SETTINGS

(75) Inventor: Akihiro Yamada, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 207 days.

(21) Appl. No.: 11/949,802

(22) Filed: Dec. 4, 2007

(65) Prior Publication Data

US 2008/0260396 A1 Oct. 23, 2008

(30) Foreign Application Priority Data

Dec. 4, 2006 (JP) ..... 2006-327351

(51) Int. Cl.
*G03G 15/00* (2006.01)
*G03G 15/08* (2006.01)

(52) U.S. Cl. ..... 399/27; 399/82

(58) Field of Classification Search ..... 399/27, 399/53, 82; 347/19; 358/406, 504
See application file for complete search history.

(56) References Cited

U.S. PATENT DOCUMENTS

| | | | | |
|---|---|---|---|---|
| 6,234,597 | B1 | 5/2001 | Suzuki et al. | |
| 6,476,836 | B2 | 11/2002 | Enami | |
| 7,440,705 | B2 | 10/2008 | Hatakeyama | |
| 2005/0185973 | A1 * | 8/2005 | Hama et al. | 399/27 |
| 2005/0226642 | A1 * | 10/2005 | Rodriguez et al. | 399/27 |
| 2006/0204257 | A1 | 9/2006 | Kawano et al. | |
| 2006/0228123 | A1 * | 10/2006 | Zaima | 399/27 X |

FOREIGN PATENT DOCUMENTS

| | | |
|---|---|---|
| JP | 09-062078 | 3/1997 |
| JP | 11-099728 | 4/1999 |
| JP | 11-334104 | 12/1999 |
| JP | 2000-132006 A | 5/2000 |
| JP | 2002-156801 A | 5/2002 |
| JP | 2003-122063 A | 4/2003 |
| JP | 2004-077819 A | 3/2004 |
| JP | 2005-070646 A | 3/2005 |
| JP | 2005-208339 A | 8/2005 |

(Continued)

OTHER PUBLICATIONS

Machine translation of JP 11-099728 A dated Sep. 1, 2009.*

(Continued)

*Primary Examiner*—Sophia S Chen
(74) *Attorney, Agent, or Firm*—Banner & Witcoff, Ltd.

(57) ABSTRACT

A printing device is provided with a printing module, an amount detecting module which detects a remaining amount of the printing material, and a first value determining module. If the remaining amount of printing material is equal to or less than a predetermined amount, the first value determining module determines a maximum value of a density range, within which a print density is to be set for printing, to be a smaller value than a maximum value of the density range when the remaining amount of printing material is larger than the predetermined amount. The printing device also includes a print density changing module configured to change the set print density to be equal to or less than the maximum value determined by the first value determining module if the set print density is greater than the maximum value determined by the first value determining module.

20 Claims, 12 Drawing Sheets

FOREIGN PATENT DOCUMENTS

| | | | |
|---|---|---|---|
| JP | 2006-251180 | A | 9/2006 |
| JP | 2006-267528 | A | 10/2006 |
| JP | 2006-284671 | A | 10/2006 |
| JP | 2006-308854 | A | 11/2006 |
| JP | 2003-186259 | | 7/2007 |

OTHER PUBLICATIONS

Machine translation of JP 2005-070646 A dated Sep. 1, 2009.*
JP Office Action dtd Mar. 3, 2009, JP Appln. 2006-327351.
JP Office Action dtd May 19, 2009, JP Appln. 2006-327351.

* cited by examiner

| | MINIMUM VALUE | INITIAL SETTING VALUE | MAXIMUM VALUE |
|---|---|---|---|
| COPY NORMAL RANGE | −6 | 1 | 6 |
| COPY TONER SAVING RANGE A | −6 | 1 | 3 |
| COPY TONER SAVING RANGE B | −6 | 1 | 1 |
| PRINT NORMAL RANGE | −7 | 0 | 7 |
| PRINT TONER SAVING RANGE A | −7 | 0 | 3 |
| PRINT TONER SAVING RANGE B | −7 | 0 | 0 |
| FAX NORMAL RANGE | −6 | 0 | 6 |
| FAX TONER SAVING RANGE A | −6 | 0 | 4 |
| FAX TONER SAVING RANGE B | −6 | 0 | 0 |
| SECOND MODE | −2 | 0 | 6 |

FIG. 5

PRINTING DEVICE HAVING PLURAL PRINT DENSITY RANGE SETTINGS

CROSS-REFERENCE TO RELATED APPLICATION

This application claims priority under 35 U.S.C. §119 from Japanese Patent Application No. 2006-327351 filed on Dec. 4, 2006. The entire subject matter of the application is incorporated herein by reference.

BACKGROUND

1. Technical Field

The present invention relates to a printing device which executes printing on recording media.

2. Prior Art

Conventionally, when a printing device prints on a recording medium, a printer driver is used to define a print density, and printing is executed. Specifically, the printer driver is set up by a user so that the print density is defined within a prescribed possible density range. Further, the printing device typically allows the user to select one of two operation modes: a normal mode where printing is executed with a print density which is within a normal density range; and a toner saving mode where printing is executed with a print density within a toner saving density range which is a lower range than the normal density range. An example of such a printing device is disclosed in Japanese Patent Application Provisional Publication No. HEI 11-99728.

The conventional printing device may be configured such that the toner saving density range is lowered in comparison with the normal density range by a predetermined amount regardless of a remaining amount of toner. In such a case, quality of the printing results is also lowered.

SUMMARY OF THE INVENTION

As an exemplary situation where printing material (e.g., toner) is to be saved, there is a situation where the remaining amount of printing material is small and printing is desired to be continued using the small amount of remaining printing material until the printing material is supplied. In such a situation, it is preferable that the quality of the printing results is remained within a certain level, and thus the density range is kept relatively higher than the usual toner saving density range.

In consideration of the above problem, the present invention is advantageous in that an improved printing device that is capable of saving printing material appropriately is provided.

According to aspects of the invention, there is provided a printing device which is provided with a printing module which executes printing on a printing medium using printing material with a set print density, an amount detecting module which detects a remaining amount of the printing material, a first value determining module configured to determine, if the remaining amount of the printing material is equal to or less than a predetermined amount, a maximum value of a density range, within which a print density is to be set for printing, to be a smaller value than a maximum value of the density range for a case where the remaining amount of the printing material is larger than the predetermined amount, a density judging module configured to judge whether the set print density is greater than the maximum value determined by the first value determining module, and a print density changing module configured to change the set print density to be equal to or less than the maximum value determined by the first value determining module if the set print density is greater than the maximum value determined by the first value determining module.

With the above configuration, the printing device allows printing material to be saved timely by prohibiting to set up a print density to be a larger value than the defined maximum value of the print density range in a case that a residue amount of printing material is lower than a prescribed amount.

According to further aspects of the invention, there is provided a method of determining a print density of images formed by a printing device which executes printing on a printing medium using printing material with a set print density. The method includes the steps of, detecting a remaining amount of the printing material, a first determining, if the remaining amount of the printing material is equal to or less than a predetermined amount, a maximum value of a density range, within which the print density is to be set for printing, to be a smaller value than a maximum value of the density range for a case where the remaining amount of the printing material is larger than the predetermined amount, judging whether the set print density is greater than the maximum value determined by the step of the first determining and changing the set print density to be a print density equal to or less than the maximum value determined by the step of the first determining if the set print density is greater than the maximum value determined by the step of the first determining.

According to still further aspects of the invention, there is provided a computer-accessible recording medium storing a program to be executed by a computer provided to a printing device. The program including instructions that cause the computer to function as a printing module which executes printing on a printing medium using printing material with a set print density, an amount detecting module which detects a remaining amount of the printing material, a first value determining module configured to determine, if the remaining amount of the printing material is equal to or less than a predetermined amount, a maximum value of a density range, within which a print density is to be set for printing, to be a smaller value than a maximum value of the density range for a case where the remaining amount of the printing material is larger than the predetermined amount, a density judging module configured to judge whether the set print density is greater than the maximum value determined by the first value determining module, and a print density changing module configured to change the set print density to be equal to or less than the maximum value determined by the first value determining module if the set print density is greater than the maximum value determined by the first value determining module.

BRIEF DESCRIPTION OF THE ACCOMPANYING DRAWINGS

FIG. 1 is a perspective view of a printing device according to the first embodiment of the present invention.

FIG. 2 schematically shows an internal configuration of the printing device shown in FIG. 1.

FIG. 3 schematically shows a cross sectional view of a development cartridge viewed from a direction A shown in FIG. 2.

FIG. 5 shows an example of a density range managing table employed in the printing device shown in FIG. 1.

Figure 8:
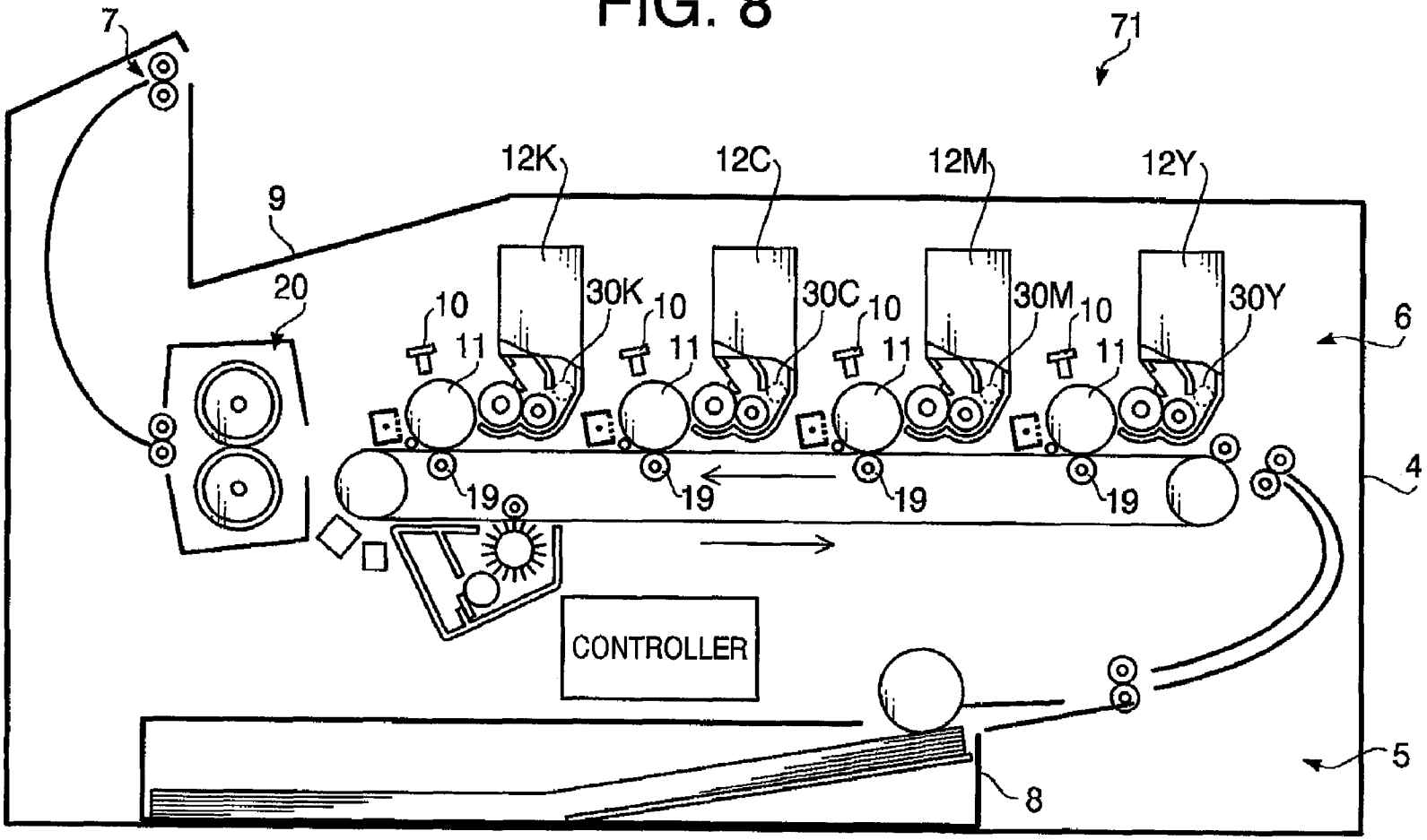

FIG. 8 schematically shows a configuration of an image forming unit which is included by the printing device according to a second embodiment.

Figure 9:
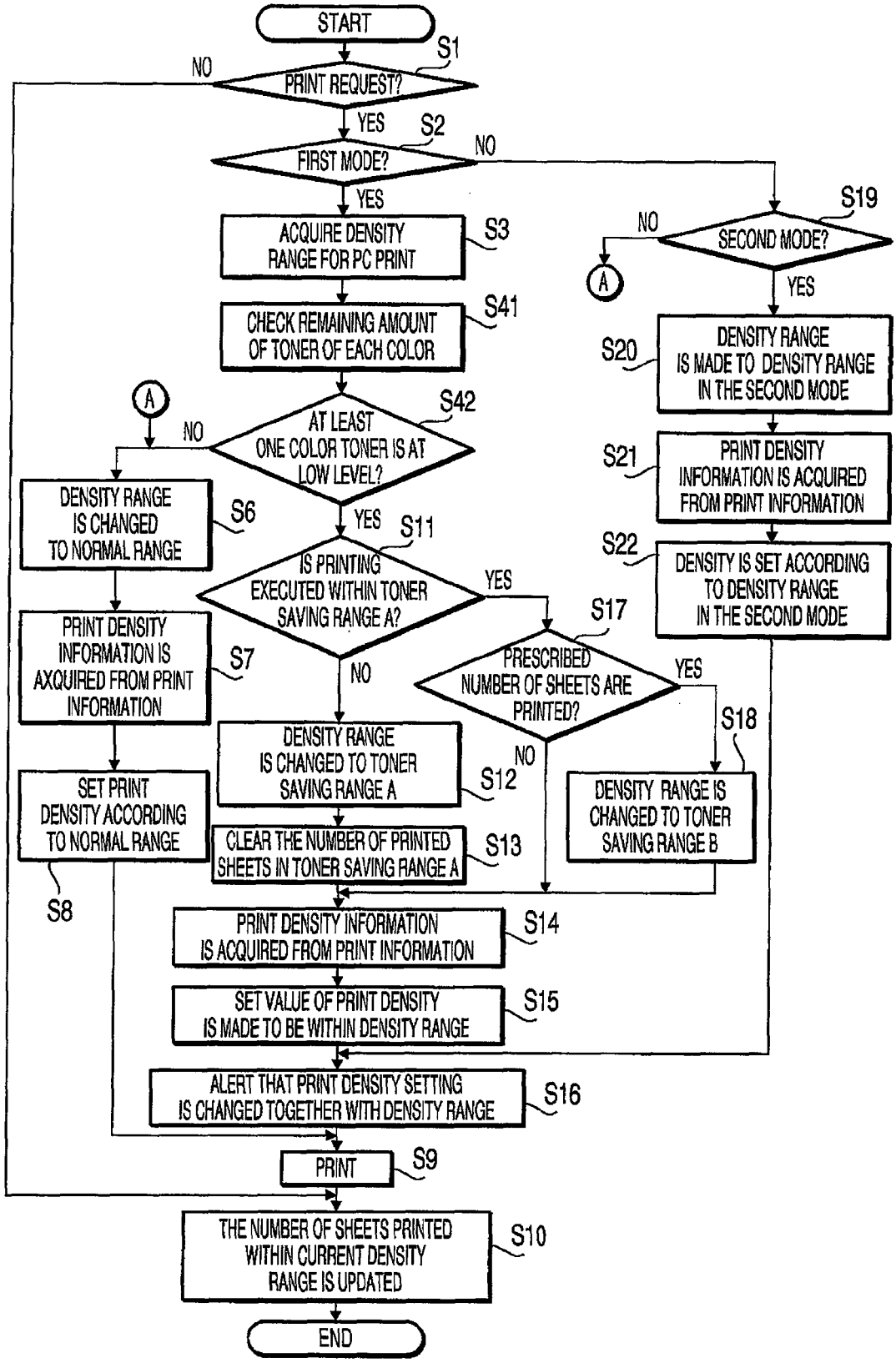
Figure 10:
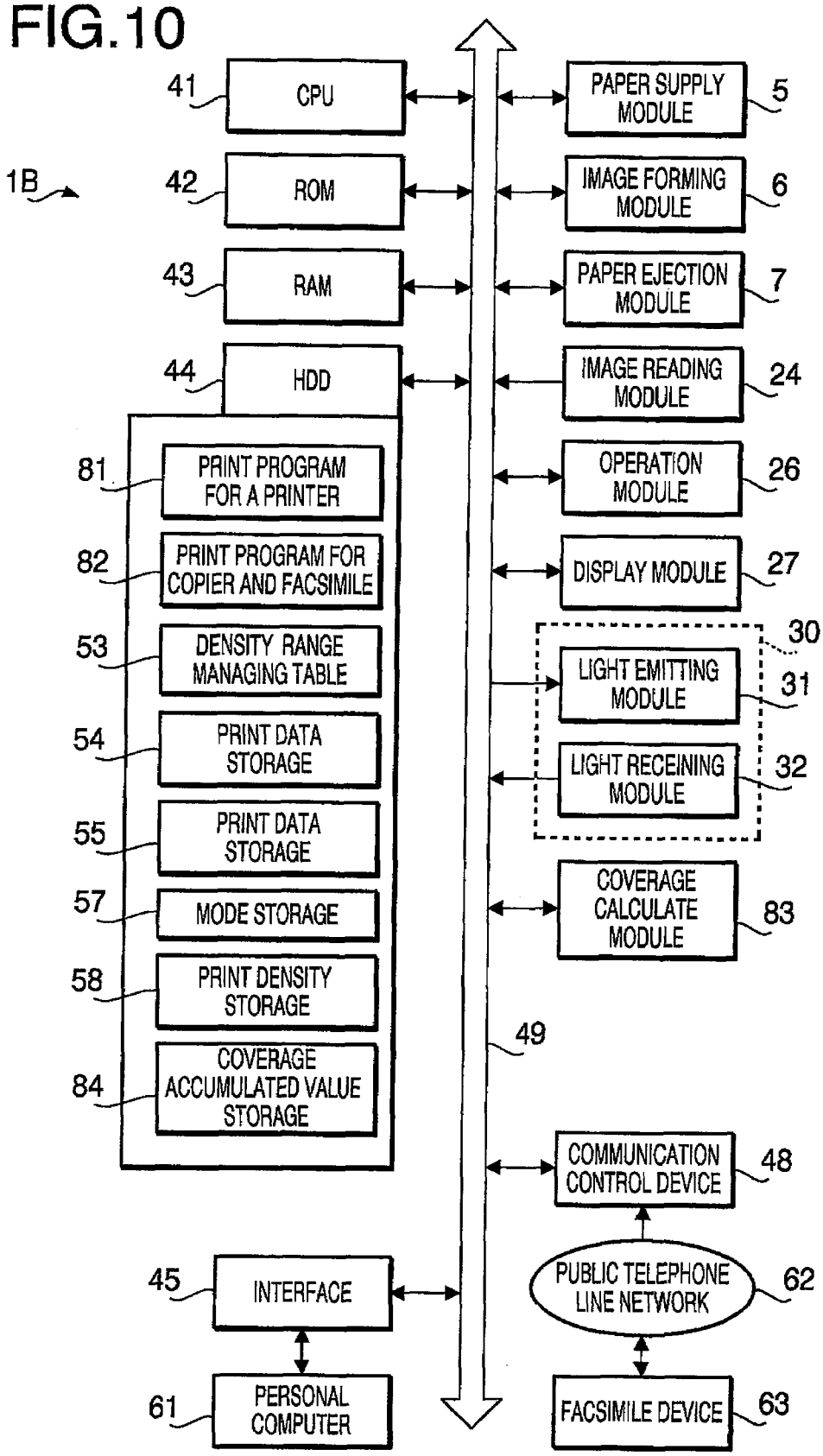

FIG. 9 is a flowchart illustrating a printing process which is executed by the printing device shown in FIG. 10.

FIG. 10 is a block diagram of a printing device according to a third embodiment of the present invention.

Figure 11:
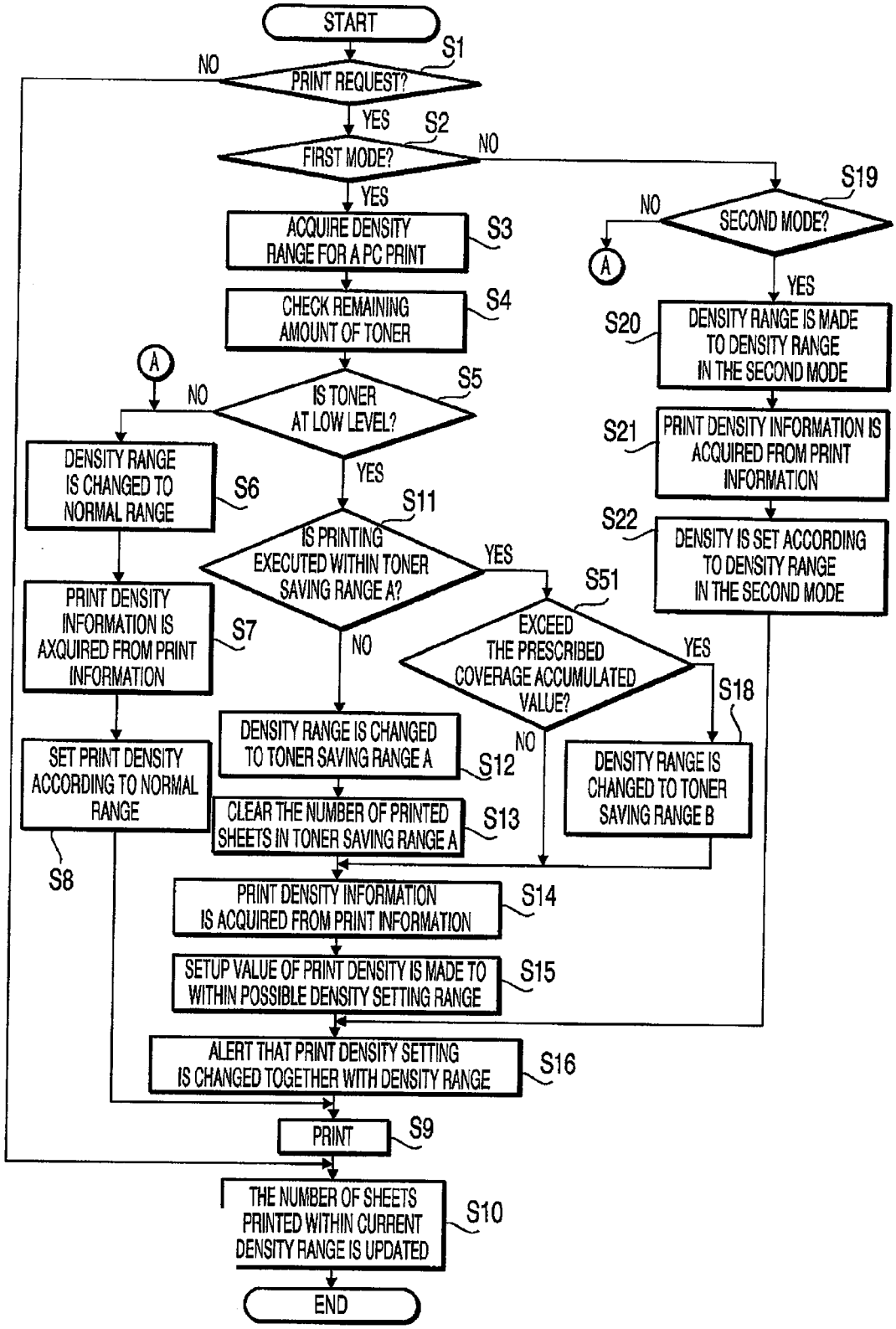

FIG. 11 is a flowchart illustrating a print process according to the third embodiment.

Figure 12:
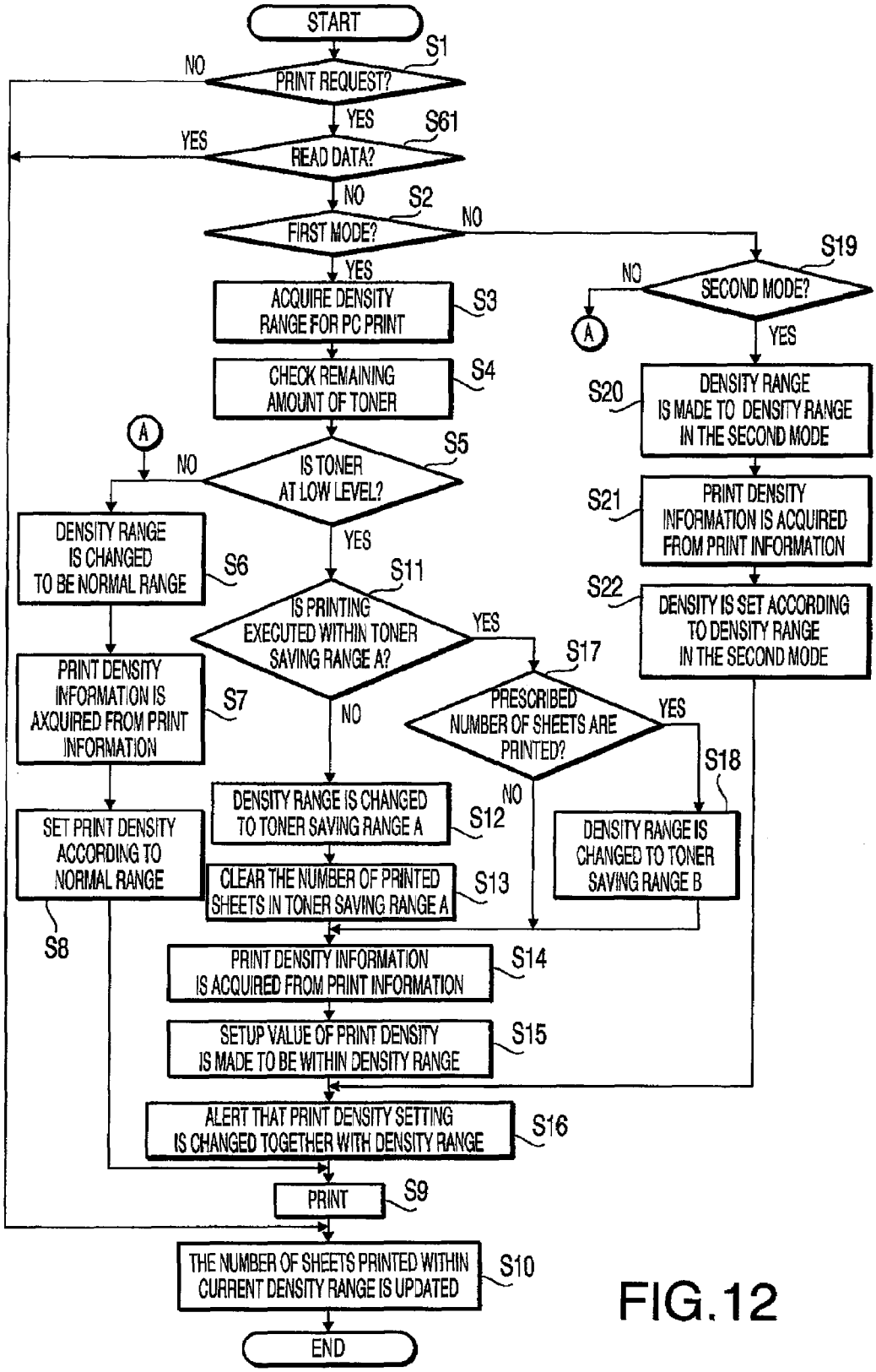

FIG. 12 is a flowchart illustrating a print program according to a modified embodiment of the present invention.

DETAILED DESCRIPTION OF THE EMBODIMENTS

Hereinafter, referring to the accompanying drawings, printing devices according to embodiments of the present invention will be described.

First Embodiment

<Overall Configuration>

Figure 1:
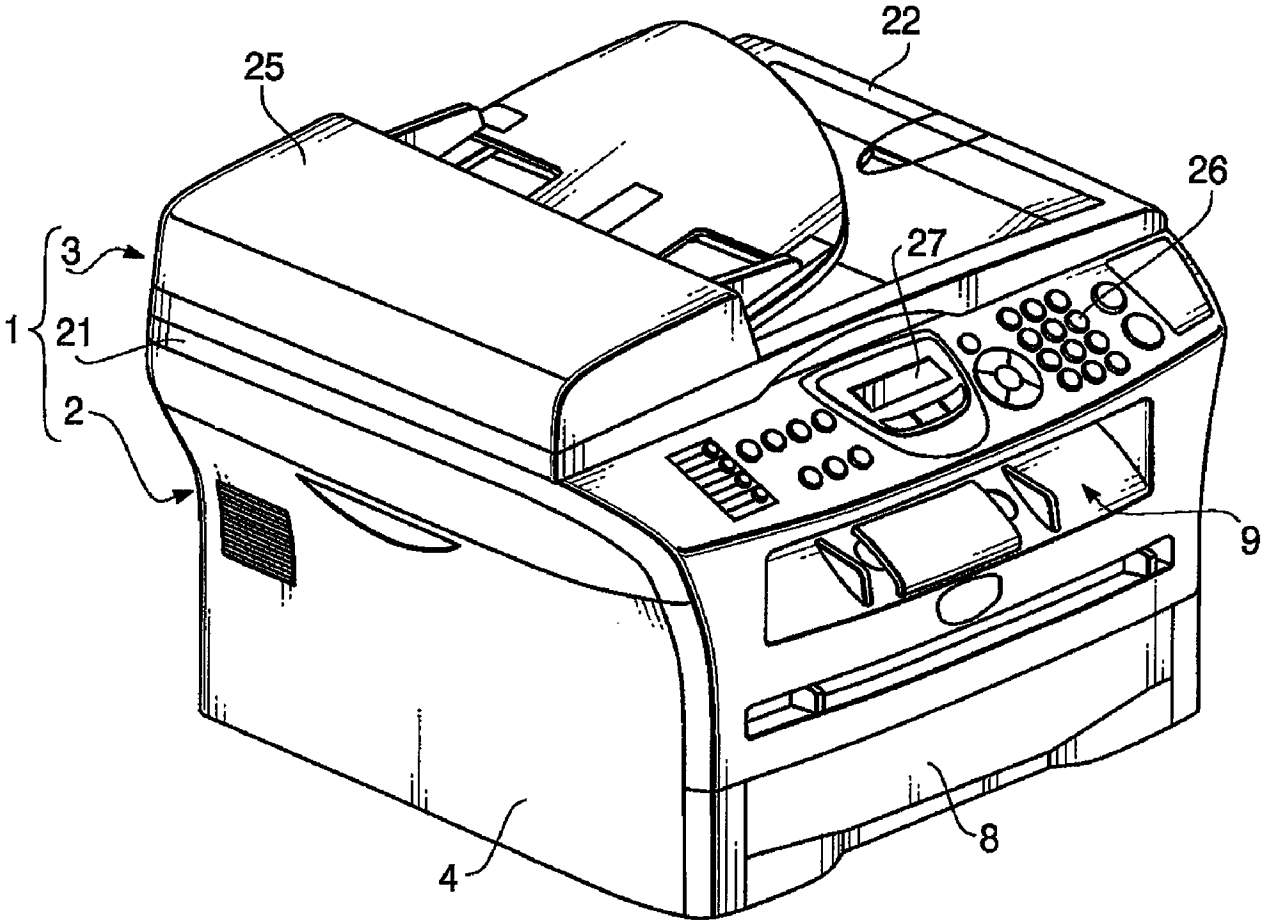

FIG. 1 is a perspective view showing an appearance of a multi function peripheral (MFP) 1 which is an example of the printing device. The MFP 1 has a scanner function, a copier function, a facsimile function and a printer function. In terms of hardware, the MDP 1 has an image forming unit 2 and an image scanning unit 3.

Figure 2:
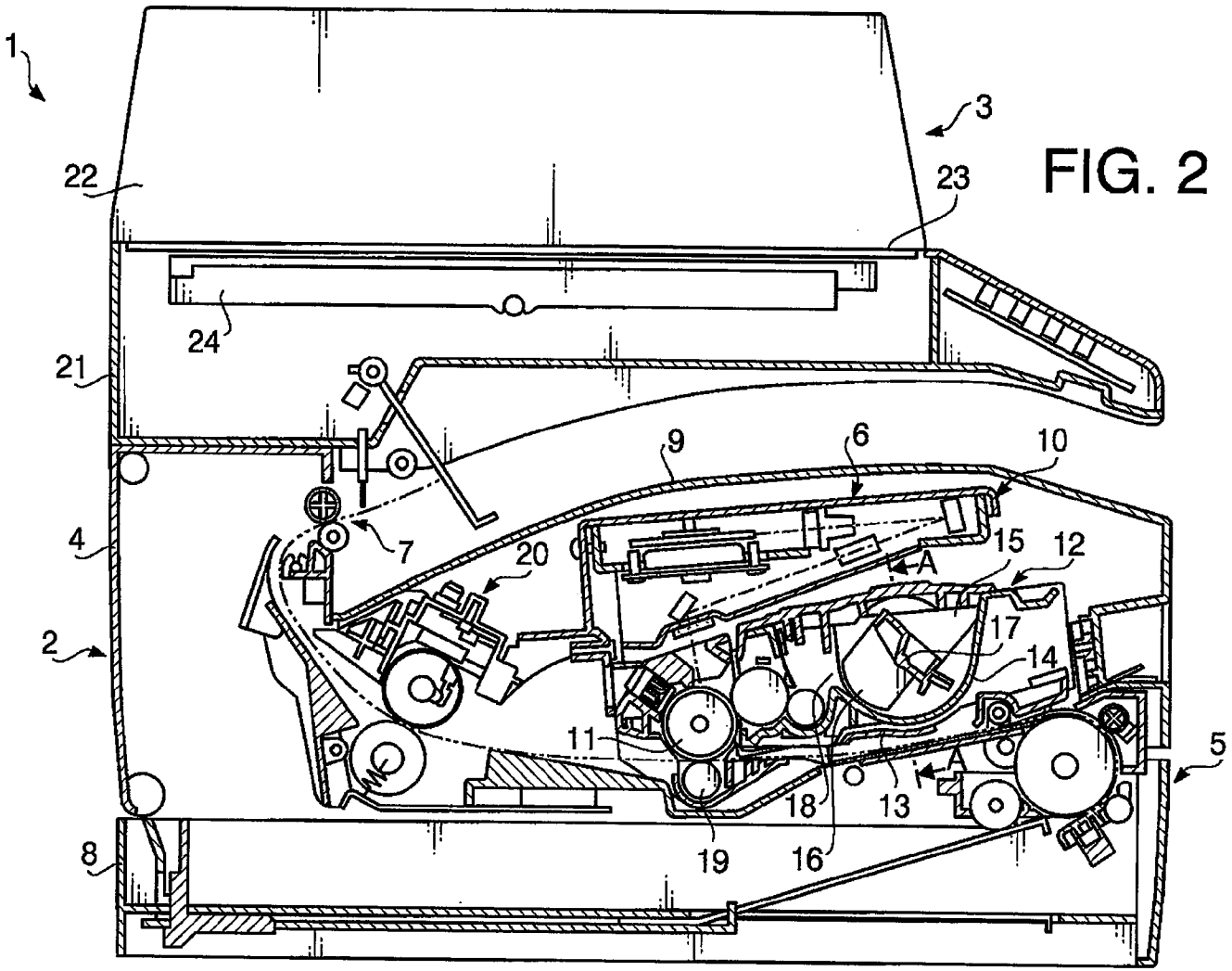

FIG. 2 schematically shows a cross sectional view showing an internal configuration of the MFP 1 shown in FIG. 1. A dotted line in FIG. 2 indicates a sheet feed path of a printing sheet which is an example of a recording medium. The image forming unit 2 includes sheet supply module 5, image forming module 6 and paper ejection module 7 in a casing 4. In the image forming unit 2, the image forming module 6 forms images on a printing sheet which is picked up from the sheet feeding cassette 8 by the paper supply module 5, and the paper ejection module 7 ejects and stacks printing sheets, on which images are formed, onto an ejected sheet tray 9.

The image forming module 6 is configured such that a laser beam is emitted from a scanner module 10 to a photosensitive drum 11 to form a latent electro-photographic image thereon. An image development module 12 visualizes the latent electro-photographic image by applying toner, which is an example of printing material, to develop the image. The developed image (toner image) on the photosensitive drum is transferred onto a printing sheet at a nip between the photosensitive drum and a transfer roller 19. A fixing module 20 fixes the toner image on the printing sheet transferred onto the printing sheet by applying heat and pressure.

The image development module 12 is configured such that a drum cartridge is attached to the casing 4 in a detachable manner. An image development cartridge 14 is attached to the drum cartridge 13 in a detachable manner. The image development cartridge 14 contains toner in a toner container 15, and releases the toner through an opening 18 to an exterior by rotating an agitator 16 about a rotational axis 17 thereof. A remaining amount of the toner in the toner container 15 is detected by a toner detect module 30 shown in FIG. 3.

Figure 3:
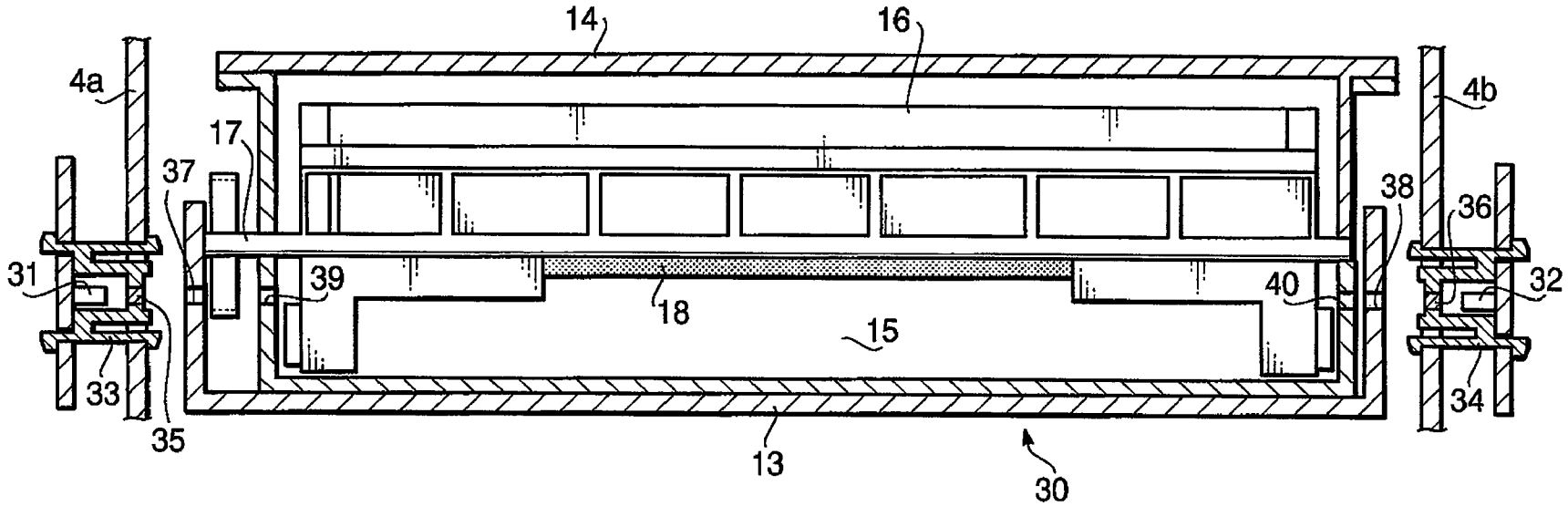

FIG. 3 is a cross section view of the toner container 15 viewed from a direction A indicated in FIG. 2. According to the first embodiment, the toner detect module 30 is an optical sensor which includes a light emitting module 31 and a light receiving module 32. The light emitting module 31 and the light receiving module 32 are fixed to side walls 4*a* and 4*b* via holders 33 and 34, respectively, such that the light emitting module 31 and the light receiving module 32 face each other with the image development cartridge 14 located therebetween. On the walls 4*a* and 4*b*, lenses 35 and 36 are fixed to face the light emitting module 31 and the light receiving module 32, respectively. Further, on the drum cartridge 13 and the image development cartridge 14 arranged between the walls 4*a* and 4*b*, light transmission windows 37, 38, 39 and 40 are provided on an optical path of a detection light which is emitted by the light emitting module 31 and received by the light receiving module 32.

With the above structure, the detection light emitted from the light emitting module 31 reaches the light receiving module 32 through the toner container 15. Since the detection light passing through the toner container 15 is partially or completely interrupted by toner depending on the remaining amount, intensity of the light varies depending on the remaining amount of the toner. The light receiving module 32 outputs a detection signal whose amplitude corresponds to the intensity of the detection light received by the light receiving module 32. Therefore, the remaining amount can be detected based on the amplitude of the detection signal.

As shown in FIG. 2, the image reading unit 3 is rotatably mounted on the image forming unit 2. Further, the image reading unit 3 is configured such that a cover 22 is rotatably (openably) mounted on a casing 21. The image reading unit 3 is configured such that an original document placed on a platen glass 23 of the casing 21 is scanned with an image sensor 24. As shown in FIG. 1, an automatic sheet feeder (ASF) 25 for transferring the original document onto the platen glass is built in the cover 22.

As shown in FIG. 1, an operation module 26 and a display module 27 are provided on an upper front surface of the casing 21. The operation module 26 allows a user to input data and/or commands according to a user operation. In the first embodiment, the operation module 26 is provided with key switches including a numeric keypad, a mode switching key, multi-function keys, etc. The display module 27 is for displaying various kinds of data. In the first embodiment, the display module 27 is configured with a liquid crystal display (LCD) panel. Optionally or alternatively, the operation module 26 may be configured with a touch panel which is formed on the display module 27 and buttons or the like displayed on the display module 27.

<Electrical Configuration>

Figure 4:
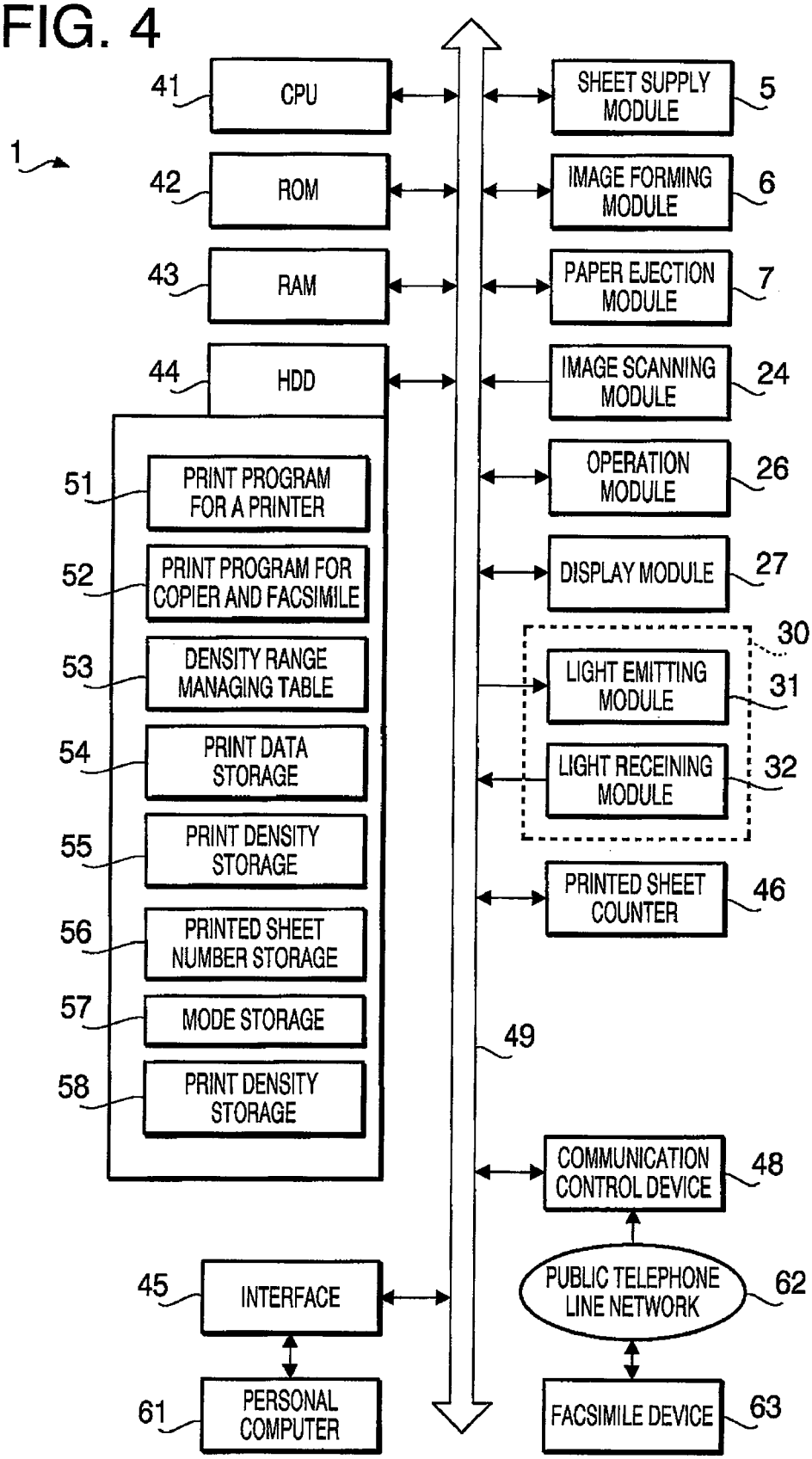
FIG. 4 is a block diagram of the printing device shown in FIG. 1.

An electrical configuration of the MFP 1 will be described. FIG. 4 is a block diagram showing the electrical configuration of the MFP 1. The MFP 1 includes a CPU (Central Processing Unit) 41, a ROM (Read Only Memory) 42, a RAM (Random Access Memory) 43, an HDD (Hard Disk Drive) 44, the operation module 26, the display module 27, an interface 45, a sheet feed module 5, the image forming module 6, the paper ejection module 7, the image scanning sensor 24, the light emitting module 31, the light receiving module 32, a printed sheet counter 46 and a communication control device 48 are interconnected through a bus 49.

The CPU 41 executes data processing and arithmetic processing, and controls overall operation of the MFP 1. The ROM 42 is a nonvolatile read-only memory and stores programs and data. The RAM 43 is a rewritable volatile memory and temporarily stores data and programs. The HDD 44 is a rewritable nonvolatile storage and stores data and programs.

In the first embodiment, the HDD 44 stores a first print program 51 for the printer function, a second print program 52 for the copier function and a density range managing table 53. In addition, in the HDD 44, a print data storage 54, a density range storage 55, a sheet count storage 56, a mode storage 57 and a print density storage 58 are provided (defined).

The first print program 51 adjusts a density range within which the user can set the print density when a print function is set up, and controls the print function to execute a printing operation in accordance with the print density set by the user.

The second print program 52 adjusts the density range within which the user can set the print density when a copier function or a facsimile function is set up, and controls the copier function or the facsimile function to execute the printing operation in accordance with the print density set by the user.

According to the first embodiment, for the print function and for the copier/facsimile function, two distinct print programs (i.e., the first and second print programs 51 and 52) are used. It is because, for the print function, the user sets the print density with a personal computer (PC) 61, while, for the copier/facsimile function, the user sets the print density on the MFP 1 side. It should be noted that, the print program may be prepared for each function of the MFP 1. Alternatively, one print program may be configured to deal with the printing operations for all or some of the functions of the MFP 1.

The density range managing table 53 is for storing density ranges for the individual functions of the MFP 1, respectively.

The print data storage 54 is for storing print data representing an image is to be formed. Specifically, in the print data storage 54, the image data received from the personal computer (PC) 62 is stored for the print function, the image data scanned by the image scanning unit 3 is stored for the copier function, and the facsimile data is stored for the facsimile function, as the print data.

The density range storage 55 is for storing the currently set density range of the MFP 1. The sheet count storage 56 is for storing the number of printed sheets which is counted by the printed sheet counter 46.

The mode storage 57 is for storing a print mode which is set when the printing operation is executed. The print mode includes a "normal mode" where normal printing is executed, a "first mode" which is a toner-saving mode where a priority is given to consumption of the toner, and a "second mode" which is also a toner-saving mode where a priority is given to the quality of image to be printed. The user can selectively set one of the "first mode" and "second mode" using the operation module 26. The print density storage 58 is for storing the currently set print density when the printing operation is executed.

The interface 45 is used for inputting/outputting data between the MFP 1 and an external device (e.g., the PC 61). The PC 61 transmits print information to the MFP 1. The print information includes a print density set up by the user as well as the image data created by the user.

The printed sheet counter 46 is for counting the number of printed sheets (i.e., the sheets on which images are printed by the image forming unit 2).

The communication control device 48 is for transmitting data to and receive data from an external device via the public telephone line network 62. To the public telephone line network 62, the facsimile device 63, which serves as the external device, is connected.

<Density Range Managing Table>

The density range managing table 53 will be explained. FIG. 5 shows an example of a density range managing table 53 shown in FIG. 4. The density range managing table 53 stores values defining a "normal range", a "toner saving range A" and a "toner saving range B" which are density ranges for the copier function, the printer function and the facsimile function, respectively. The density range managing table 53 also stores the density range corresponding to the "second mode."

Specifically, each of the density ranges stored in the density range managing table 53 stores a minimum value representing a minimum level of the density range, an initial value representing an initial value which is the density level initially set to the MFP 1 and the maximum value representing the maximum value of the density range. In the first embodiment, since image quality of a copier is dependent on status of the original document, the initial density value for the copying function is set to a higher value than the those of the print and facsimile functions.

The relationship among the density ranges stored in the density range managing table 53 will be described. The "normal range" defines a density range within which the user can arbitrarily set the print density for printing. The "toner saving range A" is configured such that the minimum value and the initial value are equal to the minimum and initial values of the "normal range," respectively, and the maximum value is smaller than the maximum value of the "normal range." The "toner saving range B" is configured such that the minimum and initial values are equal to those of the "toner saving range A" (which is also equal to those of the "normal range") and the maximum value is equal to the initial value.

The "second mode" is set such that the minimum value is greater than the minimum value of the other ranges so that the print density is prevented from being too light. Further, the maximum value of the "second mode" is equal to that of the "normal range" so that the high quality image printing as in "normal range" is guaranteed in terms of the print density of a thick image.

<Printing Operation: Printer>

Figure 6:
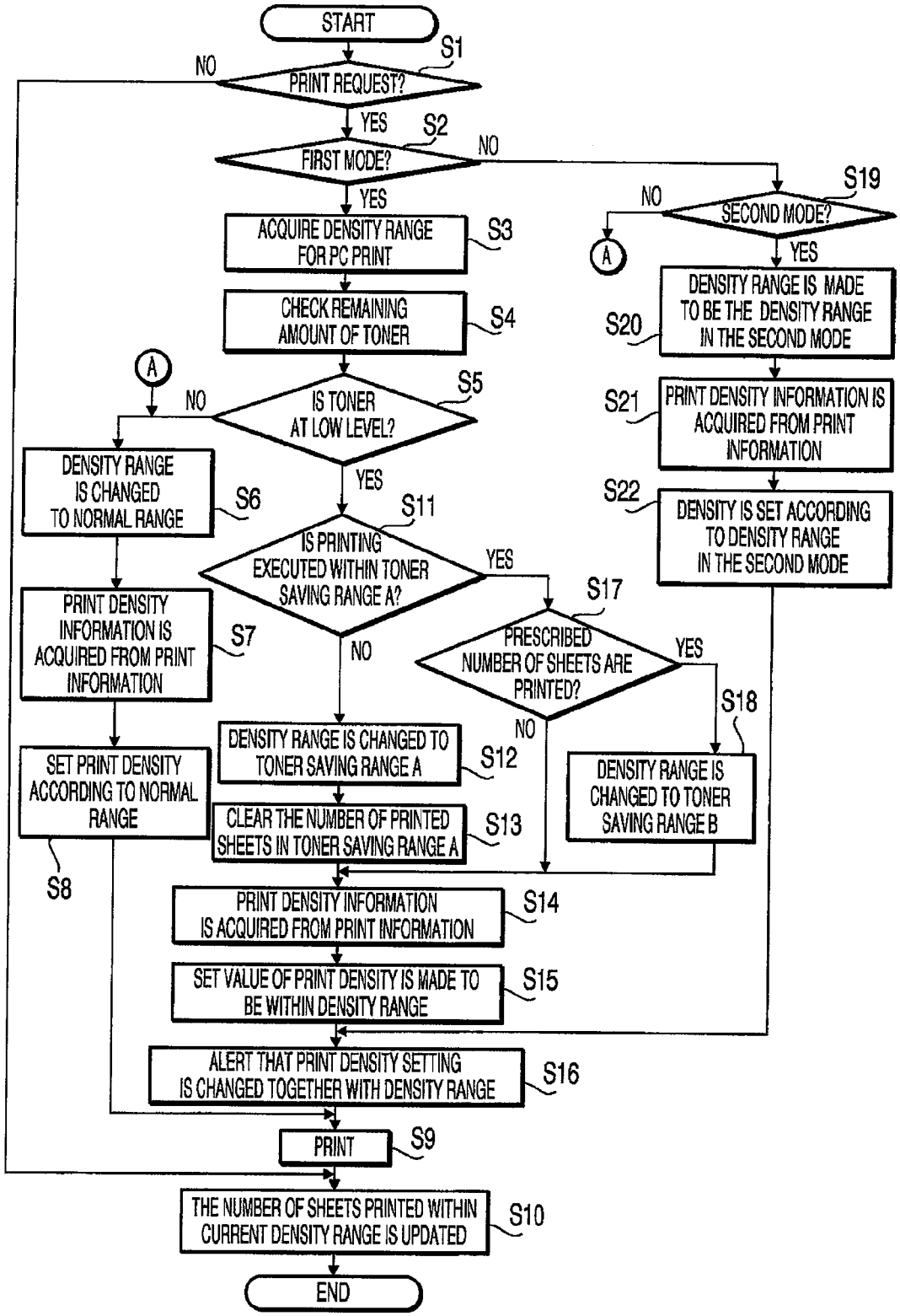
FIG. 6 is a flowchart illustrating a print process for a printer function according to the first embodiment, which is performed when a print program is executed.

The printing operation of the MFP 1 is described in detail. FIG. 6 is a flowchart of a first print process which is performed when the first print program 51 shown in FIG. 4 is executed. The first print program 51 is triggered when the MFP 1 is powered on, and is repeatedly executed at every several milliseconds. The first print process is for adjusting the density range in accordance with the mode setting input by the user through the operation module 26 and executing printing operations.

When the first print program 51 is started, the process judges whether a print request is received from the PC 61 (S1). Specifically, the process judges whether print information has been received from the PC 61 via the interface 45 and has been stored in the print data storage 54. If the print request has not been received from the PC 61 (S1: NO), the process goes to S10.

If the process judges that the print request is received from the PC 61 (S1: YES), the process judges whether the "first mode" is set. According to the first embodiment, when the user operates the operation module 26 and set the "first mode" or the "second mode," the mode set by the user is stored in the mode storage 57. If the user does not set the "first mode" or the "second mode" with the operation module 26, the "normal mode" is stored in the mode storage 57. Thus, the process judges whether the "first mode" is set by reading out a stored mode in the mode storage 57.

If the process judges that the "first mode" is set, the process reads out the density setting ranges related to the print function (i.e., the "print normal range", "print toner saving range A" and "print toner saving range B") from the density rage managing table 53 shown in FIG. 5 and copies the ranges to the RAM 43 in S3.

In S4, the process checks the remaining amount of the toner. Specifically, the process makes the light emitting module 31 of the toner detect module 30 emit a detection light, and checks the remaining amount of the toner based on the amplitude of the detection signal output by the light receiving module 32 which receives the detection light. Therefore, for example, if the output value of the detection signal is zero, the process determines that the toner container is filled with toner. If the output value of the detection signal is the maximum value, the process determines that the toner container is empty. If the output value of the detection signal is between zero and the maximum value, the process determines the remaining amount of the toner in accordance with the output value of the detection signal.

Then, in S5, the process judges whether the toner in the toner container 15 is at a "low" level. It should be noted that the process determines that the toner in the toner container 15 is at the low level when the remaining amount of the toner detected in S4 is equal to or less than the "first prescribed amount." For example, in the first embodiment, the "first prescribed amount" is defined to be 10% of the amount when the toner container is filled with the toner.

When the process determines that the remaining amount of the toner is greater than the first prescribed amount, or the toner is not at the low level (S5: NO), there is little possibility of shortage of toner even if printing is continued. Therefore, in this case, in S6, the process changes the density range stored in the density range storage 55 to the "print normal ranger" that has been copied in RAM 43 in S3. Then, in S7, the process retrieves the print information from the print data storage 54, extracts the print density information included in the retrieved print information, and stores the extracted print density information in the RAM 43.

Then, in S8, the process compares the print density information stored in the RAM 43 with the "print normal range" stored in the density range storage 55, and sets the print density to be used within the "print normal range." Specifically, for example, if the print density information extracted from the print information is "5", since the print normal range is "−6 to +6" (see FIG. 5), the print density "5" is within the "print normal range." In such a case, the print density "5" is stored in the print density storage 58.

Thereafter, in S9, the process prints the image data included in the print information received from the personal computer 61 on the printing sheet with the print density stored in the print density storage 58. Then, in S10, the process updates the number of printed sheets stored in the printed sheet counter 46. Specifically, the process adds the number of printed sheets counted by the printed sheet counter 46 during a printing job to the number of printed sheets corresponding to the "print normal range" and stored in the sheet count storage 56. Then, since one print job has been finished, the process is terminated.

If the amount of the toner in the toner container 15 is at the low level, or equal to or less than the "first prescribed amount" (S5: YES), there is high possibility of shortage of toner when printing is continued. Thus, in such a case, the process judges whether printing is executed with the "print toner saving range A" in S11 to check if the MFP 1 operates in the toner saving mode. Specifically, the process refers to the density range storage 55, and judges whether the "print toner saving range A" is set.

If the amount of the toner changes from at the non-low level to at the low level, the density range storage 55 is set to the "print normal range" and has not been set to the "print toner saving range A." In such a case (S11: NO), in S12, the process changes the "print normal range" stored in the density range storage 55 to the "print toner saving range A."

Then, in S13, the process clears the number of printed sheets corresponding to the "print toner saving range A" stored in the sheet count storage 56. Then, in S14, the process retrieves the print information stored in the print data storage 54 and stores the same into the RAM 43, and obtains the print density information from the print information.

In S15, the process sets the print density information to represent a value within the "print toner saving range A." Specifically, if the print density information represents, for example, "+5", whereas the print toner saving range A is "−7 to +3", the value represented by the print density information is not within the print toner saving range A. In the case, the process changes the print density "+5" to the maximum value "+3" of the print toner saving range A, and stores the changed (or, adjusted) value in the print density storage 58. If the print density information represents a value within the "print toner saving range A", the value represented by the print density information is stored as it is in the print density storage 58.

In S16, the process notifies (issues a warning message) that the print density set by the user has been changed together with the "print toner saving range A." Specifically, for example, if the print density "+5" which was set by the user has been changed to "+3," the process generates a warning message notifying the user of fact that the print density set by the user has been changed and the new value (i.e., changed value) of the print density. Then, the process transmit the warning message to the PC 61 together with the "print toner saving range A" in order to notify the change to the user. It sometimes occurs that the user may move to the MFP 1 after the user transmitted the print information from the PC 61 to the MFP 1. Therefore, the similar warning message is displayed on the display module 27 of the MFP 1.

In S9, the process prints out the image data on the printing sheet with the print density stored in the print density storage 58. Then, in S10, the process adds the number of printed sheets counted by the printed sheet counter 46 to the number of printed sheets stored in the sheet count storage 56 in relation with the "print toner saving range A," thereby updating the number of printed sheets stored in the sheet count storage 56. With the above process, one print job is finished, and the process is terminated.

When the "first mode" is set in the mode storage 57 (S2: YES), and the "printer toner saving range A" is set in the density range storage 55, and printing is executed (S11: YES), the process checks whether the prescribed number of sheets have been printed in S17 the density range is changed to the "printer toner saving range A." Specifically, referring to the printed sheet count storage 56, the process judges whether the number of printed sheets corresponding to the "print toner saving range A" reaches the prescribed number. According to the first embodiment, the "prescribed number of printed sheets" is defined as the number of printed sheets which is considered to reduce the toner from the "first prescribed amount" to the "second prescribed amount." For example, in the first embodiment, the "second prescribed amount" is defined as 5% of the amount of the toner when the container 15 is filled with the toner.

If the process has determined that the prescribed number of sheets have not been printed (S17: NO), the process goes to S14, where the print density is set to be within the "print toner saving range A," and printing is executed. Since processes after S14 are described above, further explanation will be omitted for brevity. When the printing is completed, the process is terminated.

If the process determines that that the prescribed number of sheets have been printed (S17: YES), the "printer toner saving range A" is changed to the "print toner saving range B" so that consumption of the toner can be further saved in S18. That is, the process retrieves the values defining the "print toner saving range B" from the RAM 43, and changes the values defining the "print toner saving range A" stored in the density range storage 55, thereby the density range stored in the density range storage 55 is updated to the "print toner saving range B."

Thereafter, the process goes to S14, sets the print density so that the density is within the "print toner saving range B," and executes the printing operation. Since processes S14 onwards have been described above, the explanation is omitted for brevity. When the printing operation has been completed, the process is terminated.

In the meantime, it is sometimes necessary that high print quality is required regardless of the remaining amount of the toner. To deal with such a requirement, the MFP 1 is configured to operate in the "second mode" which gives priority to high print quality. The "second mode" can be selected with an operation module 26.

In S1, if the print request is received from the personal computer 61 (S1: YES) and the "first mode" is not set (S2: NO), the process judges whether the "second mode" is set (S19). Specifically, the judgment in S19 is made based on whether the mode storage 57 stores the "second mode."

If the mode storage 57 does not store the "first mode" or the "second mode" (S2: NO; S19: NO), the process goes to S6, sets the print density within the "print normal range" and executes printing. Since processes after S6 are described above, the explanation will not repeated for brevity.

If the mode memory module 57 stores the "second mode," that is, the "second mode" is set (S19: YES), the process retrieves the density range of the "second mode" from the density range managing table 53, and replace the density range stored in the density range storage 55 with the retrieved density range of the "second mode."

Then, in S21, the process copies the print information stored in the print data storage 54 into the RAM 43, and extracts the print density information from the print information. In S22, the process compare the extracted print density information with the density range of the "second mode" stored in the density range storage 55, and sets the print density so as to have a value within the density range of the "second mode."

Since the minimum value of the density range of the "second mode" is greater than the minimum values of other density ranges, it is prohibited to make the print density lighter in comparison with a case where other density ranges are used. Thus, for example, if the print density information represents "−5", whereas the density setting possible range of the "second mode" is "−2 to +7", the process changes the value of the print density information "−5" to "−2" which is the minimum value of the density range of the "second mode," and stores the value in the print density storage 58. With this change, the image quality intended by the user can be realized as much as possible.

After the print density is set in the above-described manner, the process transmits the warning message to the PC 61 together with the density range of the changed "second mode" to warn (notify) the user (S16). The warning (notice) is also displayed on the display module 27 of the MFP 1. Thereafter, in S19, the process prints out the image data on the printing sheet in accordance with the changed print density.

When the printing is executed, the printed sheet counter 46 counts the number of printed sheets. Thus, in S10, the process adds a count value of the printed sheet counter 46 to the number of printed sheets corresponding to the density range of the "second mode" stored in the sheet count storage 56, thereby updating the number of printed sheets stored in the sheet count storage 56. Then, the process is terminated.

<Printing Operation: Copier and Facsimile>

Next, printing operation when the MFP 1 functions as a copier or facsimile will be described.

Figure 7:
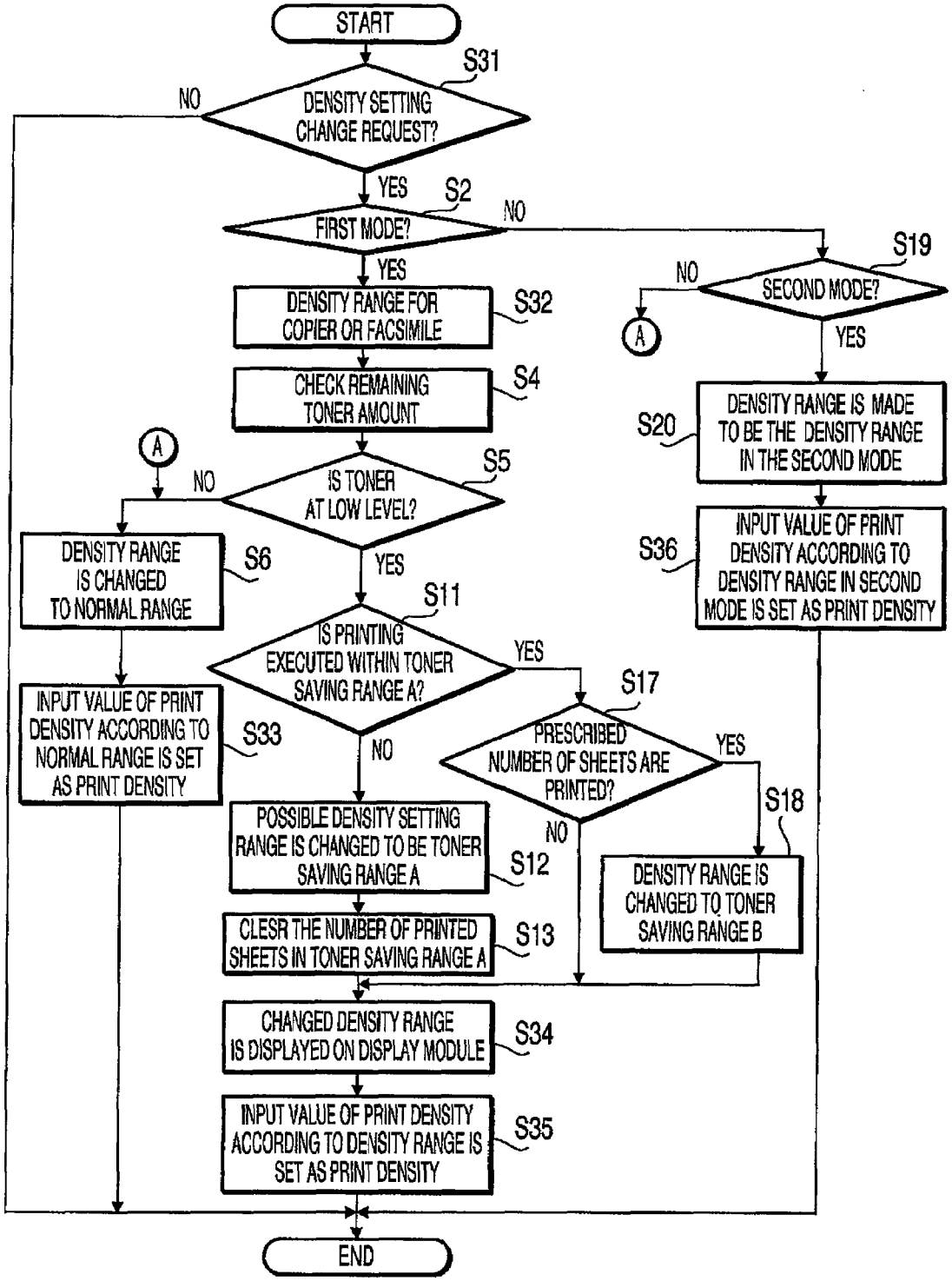
FIG. 7 is a flowchart illustrating a print process for copier/facsimile functions according to the first embodiment.

FIG. 7 is a flowchart showing a print process which is performed when a print program 52 for a copier and a facsimile shown in FIG. 4 is executed by the CPU 41.

Since the copying function prints out the image data which is obtained by scanning an original document, the print density that set by the user depends on the original document. Further, in the facsimile function, when facsimile data is transmitted from an external facsimile device to the MFP 1, a scanning density is set at the external facsimile device. Therefore, when the MFP 1 operates as the copier or the facsimile device, the print density cannot be fixed, differently from the printing device. Therefore, in the MFP 1, a print program 52 for the copier and facsimile functions is installed independently from a print program 51 for the printer function. The program 52 executes slightly different processes to execute printing in comparison with the processes of the print program 51 for the printer function.

Therefore, in the following description regarding the copier and facsimile functions of the MFP 1, processes different from the printer function are mainly described. The steps similar to those of the printer function are given the same step numbers in the flowchart and description thereof will be omitted/simplified for brevity.

In the print process for the copier function and the facsimile function, the process judges whether there is a request for changing the density setting in S31. The reason why the process judges presence/absence of the request for changing the density setting, not a request for printing, is that, when the MFP 1 operations as the copier or the facsimile device, it is necessary to adjust the density range when the user operates the operation module 26 and makes the density setting. If the process determines that there is not the request for changing the density setting (S31: NO), the process is terminated.

If the process determines that there is a request for changing the density setting (S31: YES), the process goes to S2, and judges whether the "first mode" is set. If the "first mode" is set, in S32, the process retrieves the density range for the copier from the density range managing table 53, and stores the retrieved range into the RAM 43.

In S4, the process checks the remaining amount of the toner to determine whether the toner is at the low level in S5. If the toner is not at the low level (S5: NO), in S6, the process replaces the density range stored in the density range storage 55 with the "COPY normal range" that is stored in the RAM 43.

In S33, the process sets an input value according to the "COPY normal range" as the print density. Specifically, the process displays the "COPY normal range" on the display module 27, and requires the user to input the print density within the displayed range. Then, the process stores the input print density in the print density storage 58. When the setting of the print density is completed, the process is terminated.

If there is a request for change of the density setting when copying is executed (S31: YES), the "first mode" is set (S2: YES), and the toner is at the low level (S5: YES), the process judges in S11, whether printing is executed using the "COPY toner saving range A".

If the printing is not executed using the "COPY toner saving range A" (S11: NO), in S12, the process changes the density range to the "COPY toner saving range A," and afterwards, in S13, the process clears the number of printed sheets using the "COPY toner saving range A."

In S34, the process retrieves the values defined by the "COPY toner saving range A," which is changed in S12 from the "COPY normal range", from the density range storage 55 and displays the retrieved values on the display module 27. Thereby, the user is allowed to select a value of the print density only within the "COPY toner saving range A."

In S35, the process sets the input value which is input according to the displayed density range as the print density. That is, the process stores the print density which the user inputs through the operation module 26 by selecting a value of the print density within the "COPY toner saving range A" displayed on the display module 27. If setting of the print density was completed, the process is terminated.

If there is a request for change of the density setting (S31: YES) when copying is executed, the "first mode" is set (S2: YES), and the toner is at the low level (S5: YES), and further if printing is executed using the "COPY toner saving range A" (S11: YES), the process judges in S17, whether the prescribed number of sheets are printed.

If the process determines that the prescribed number of sheets have not been printed (S17: NO), the process goes to S34 to display the "COPY toner saving range A" on the display module 27, and in S35, the process sets the print density within the "COPY toner saving range A." Then, the process executes printing with the print density that is set. When the printing has been completed, the process is terminated.

If the process determines that the prescribed number of sheets have been printed (S17: YES), in S18, the process retrieves the "COPY toner saving range B," which is copied from the density range managing table 53 to the RAM 53, and replaces the "COPY toner saving range A" stored in the density range storage 58 with the "COPY toner saving range B."

Thereafter, the process goes to S34, and displays the "COPY toner saving range B" on the display module 27. Then, in S35, the process stores a value input by the user through the operation module 26 according to the "COPY toner saving range B" in the print density storage 58 as the print density. If setting of the print density is completed, the process is terminated.

Next, a case where the user has set the "second mode" through the operation module 26 will be explained.

If the user inputs a density setting change instruction through the operation module 26 when the user copies the original document (S31: YES), the process determines that the "second mode" is set (S19: YES), but not the "first mode" (S2: NO). Then, in S20, the process changes the density range stored in the density range storage 55 to the density range of the "second mode."

In S36, the process sets the input value according to the density range of the "second mode" as the print density. Specifically, if the print density that the user inputs through the operation module 26 is within the density range "−2 to +6" of the "second mode," the input print density is stored in the print density storage 58. If the print density that the user input through the operation module 26 is out of the density range of the "second mode", the input value is not stored in the print density storage 58. In this case, the process waits until the input value is set within the density range of the "second mode". If setting of the print density has been completed, the process is terminated.

If the process determines the print density as described above, the user makes the image scanning unit 3 to scan the original document, and makes the print data storage 54 to store the scanned data. Then, the user operates the operation module 26 to start copying. The image forming module 2 prints the scanned data onto a printing sheet according to the print density stored in the print density storage 58.

The print density for the facsimile is set similarly to the print density for the copier. In a case of a facsimile device, the facsimile data is transmitted to the MFP 1 through the public telephone line network 62, and the print density is set in the facsimile data which is generated by the facsimile device 63 at the sending station. Thus, in the case of the facsimile device, the print density contained in the facsimile data is compared with the density range, and the process stores the print density in the print density storage 53 if the print density is within the density range.

On the contrary, if the print density transmitted from the facsimile device 63 is out of the density range, it is desirable that the process withholds the printing of the facsimile data until the user sets the print density according to the density range.

In the MFP 1 according to the first embodiment, if the remaining amount of the toner detected by the toner detect module 30 is at the low level (i.e., less than the prescribed amount) (S5 in FIG. 6: YES), the process stores the "toner saving range A" or the "toner saving range B" in the density range storage 55, thereby the maximum value of the density range is defined to be a smaller value than the maximum value to be defined when an amount of printing material is more than a prescribed amount (see S12 and S18 in FIG. 6, S12 and S18 in FIG. 7).

If the user sets, with the PC 61 or using the operation module 26, the print density that is greater that the maximum value of the "toner saving range A" or the "toner saving range B," the process sets the print density a value which is smaller the maximum value of which the user sets up is made to be a value less than or equal to the maximum value of the "toner saving range A" or the "toner saving range B" (see S15 in FIG. 6; S35 in FIG. 7).

Therefore, in the MFP 1 according to the first embodiment, if the remaining amount of the toner is at the low level (equal to or less than the prescribed amount), the process restrict the user from setting the print density to a value greater than the maximum value of the "toner saving range A" or the "toner saving range B." Therefore, consumption of the toner can be suppressed timely. With this configuration, for example, if the user does not note the toner is at the low level and sets the print density to a relatively large value, an undesirable situation where the toner is running out before obtaining a development cartridge 14 for replacement can be avoided.

Further, in the MFP 1 according to the first embodiment, if the toner is at the low level, the process lowers the maximum value of the "toner saving range A" in comparison with the maximum value of the "normal range" (FIG. 5; FIG. 6, S5: YES, S12; FIG. 7, S5: YES, S12).

Then, under the condition that the number of printed sheets is equal to or greater than the prescribed number of sheets after the process detects that the toner is at the low level (FIG. 6, S17: YES), the process determines that the remaining amount of the toner is less than the amount when the toner was detected to be at the low level (which will be referred to as the second prescribed amount). In the above case, a value (the second value) which is smaller than the maximum value (i.e., the first value) of the "toner saving range A" is defined to be the maximum value of the "toner saving range B" (FIG. 5; FIG. 6, S18; FIG. 7, S18).

As described above, the process gradually reduces stepwise the maximum value of the density range according to the remaining amount of the toner (see FIG. 5). Therefore, the MFP 1 according to the first embodiment can save toner while satisfying a user's request for a print density as much as possible.

In the MFP 1 according to the first embodiment, the user is allowed to operate the PC 61 or the operation module 26 to change the initial setting value shown in FIG. 5 to set the print density. If the process determines that the remaining toner amount is less than the second prescribed amount as the prescribed number of sheets are printed after printing is executed within the "toner saving range A" (FIG. 6, S17: YES), the process sets the initial setting value of the print density shown in FIG. 5 to be the maximum value of "toner saving range B," so that the user is prohibited from setting the higher print density than the initial setting value (FIG. 5, FIG. 6, S18; FIG. 7, S18).

According to the MFP 1 of the first embodiment, since printing is executed with the print density which is lower than the initial setting value if the remaining amount of the toner is small. Therefore, a running time in which printing can be extended can be elongated with securing substantially normal print quality.

The MFP 1 according to the first embodiment is configured to measure the number of printed sheets with the sheet counter 46. After the process detects that the toner is at the low level, the number of the printed sheets as countered is accumulatively stored in the sheet count storage 56. When the stored number of printed sheets reaches the prescribed number, the process determines that printing of the prescribed number of sheets is executed and determines that the remaining amount of the toner is the second prescribed amount (FIG. 6, S5, S11 and S17:YES).

Therefore, according to the MFP 1 of the first embodiment, for example, even if detection precision of the toner detect module 30 which detects the amount of the toner is relatively low, since the remaining amount of the toner is predicted according to the number of actually printed sheets, prediction accuracy of the toner amount can be improved.

The MFP 1 according to the first embodiment is configured such that the user can select the "first mode" where priority is given to saving of the toner or the "second mode" where priority is given to quality of image by operating the operation module 26. If the user selects the "first mode," the maximum value of the density range is limited to be retained or decreased depending on the remaining amount of the toner. If the user operates the operation module 26 to select the "second mode," the print density can be set to a high level regardless of the remaining toner amount. Therefore, the printing operation is not constrained by the "first mode", and the high quality printing result can be achieved. Thus, the usability is improved.

Further, the MFP 1 according to the first embodiment is configured to notify the changed density range (including the maximum value) and the fact that the value has been changed in a case where the print density set by the user is changed (FIG. 6, S16). Therefore, it can be prevented that the print density is changed while the user does not recognize the change. Particularly, when the printer function is utilized, since the user sets the print density on the PC 61 which is generally remote from the MFP 1, it is convenient to the user that the warning is output to the PC 61.

Second Embodiment

Next, the printing device according to the second embodiment of the present invention will be described. As an exemplary embodiment of the printing device, an image forming unit 71 (see FIG. 8) will be described.

FIG. 8 schematically illustrates the image forming unit 71 which can be employed in an MFP similar to the MFP 1 according to the first embodiment. Since the configuration of an image scanning module 3 of the MFP according to the second embodiment is the same as that of the MFP 1 according to the first embodiment, it is omitted in FIG. 8 for brevity.

As shown in FIG. 8, the image forming module 6 of the image forming unit 71 is provided with development modules 12Y, 12M, 12C and 12K respectively accommodating toner of yellow (Y), magenta (M), cyan (C) and black (K). The image forming unit 71 is provided with toner detect modules 30Y, 30M, 30C and 30B for detecting the remaining amounts of the toner in the development modules 12Y, 12M, 12C and 12K, respectively. Since configurations of the toner detect modules 30Y, 30M, 30C and 30K are similar to the configuration of the toner detect module 30 of the first embodiment, the description is omitted for brevity.

The image forming unit according to the second embodiment uses a plurality of colors of toner. Therefore, the printing program is configured so that the maximum value of the density range of each color toner is lowered if the remaining amount of the toner of one of the plurality of colors of toner becomes equal to or less than the "first prescribed amount" so that the print density that a user can set is restricted.

FIG. 9 is a flowchart of a printing process which is performed when a printing program according to the second embodiment is executed by the image forming device according to the second embodiment.

The printing process shown in FIG. 9 is similar to the printing process shown in FIG. 6 except for steps S41 and S42. Therefore, in the following description, only the different steps will be described.

According to the printing process shown in FIG. 9, the process receives acquires detection results of the toner detect modules 30Y, 30M, 30C and 30K in S41, and checks the remaining amount of the toner of each color. In S42, the process determines whether the toner of one of the plurality of colors is at the low level. That is, the process determines if any of the remaining amount of the toner detected at S41 is equal to or less than the "first prescribed amount" to determine whether the toner of at least one of the plurality of colors is at the low level.

If the toner of at least one of the plurality of colors is not at the low level (S42: NO), the process goes to S6, and executes printing with setting the print density within the normal range (S8). If the toner of at least one of the plurality of colors is at the low level (S42: YES), the process goes to S11, and executes printing with setting the print density within the "toner saving range A" or the "toner saving range B."

As above, according to the image forming device of the second embodiment, if the remaining amount of the toner of at least one of the plurality of colors decreases to be equal to or less than the "first prescribed amount," the process limits the maximum value of the density range for each color toner to save the consumption of the toner of each color. With this configuration, it is possible to prevent the situation where printing cannot be executed due to shortage of at least on of the plurality of color toners earlier than the other color toners.

Third Embodiment

Next, the printing device according to the third embodiment of the present invention will be described. In the third embodiment, an MFP 1B will be described as an example of the printing device. The configuration of the MFP 1B according to the third embodiment is similar to the configuration of the MFP 1 except that the MFP 1B of the third embodiment further detects whether the remaining amount of the toner is equal to or less than a second prescribed amount. In the following description of the third embodiment, different portions of the MFP 1B in comparison with the MFP 1 according to the first embodiment will be mainly described.

FIG. 10 is a block diagram of the MFP 1B according to the third embodiment. The MFP 1B is configured to store a print program 81 for printing and a print program for a copier/facsimile 82 in the HDD 44. The print program 81 for printing and the print program 82 for the copier/facsimile are different from the print program 51 for the printer and the print program 52 for the copier/facsimile of the first embodiment only in a point where a Coverage accumulation value is used to determine whether the remaining amount of the toner is equal to or less than the "second prescribed amount."

Therefore, the MFP 1B is provided with a Coverage calculate module 83 instead of the sheet counter 46 that is employed in the MFP 1 of the first embodiment. Further, the MFP 1B is provided with a Coverage accumulated value storage 84 instead of the sheet count storage 56 of the first embodiment.

The Coverage calculate module 83 is for calculating the Coverage. "Coverage" is, for example, a parameter indicating a degree of printing in percentage. Specifically, the Coverage represents an amount of printed letters/images etc. on a letter size sheet whereas it represents 100% if the letter/images would be fully printed on the same sheet. "Coverage accumulation value" is an accumulated value of the Coverage for each sheet which is calculated by the coverage calculate module 83 when printing is executed for each sheet.

FIG. 11 is a flowchart illustrating a print process when the print program 81 shown in FIG. 10 is executed by the CPU 41. The process determines whether the Coverage accumulation value exceeds a prescribed Coverage accumulation value (i.e., a reference value) in S51. Specifically, the Coverage calculate module 83 calculates the Coverage when printing, and the process accumulatively stores the calculated Coverage in the Coverage accumulated value storage 84. Then, the process retrieves the Coverage accumulation value, which is stored in the Coverage accumulated value storage 84. Then, the process compares the retrieved Coverage with the reference value to judge whether the Coverage accumulative value exceeds the reference value (S51).

Incidentally, the "reference value" is the Coverage accumulation value which is thought to decrease the toner from the "first prescribed amount" to the "second prescribed amount." in the third embodiment, the "first prescribed amount" is the remaining amount which is 10% of an amount of the filling the toner container, and the "second prescribed amount" a remaining mount which is 5% of an amount filling the toner container.

If the process determines that the Coverage accumulation value does not exceed the reference value (S51: NO), the process executes steps S14 onwards, where the process sets the print density within the toner saving range A, and executes printing.

If the process determines that the Coverage accumulation values exceeds the reference value (S51: YES), the process goes to S18. In S18, the process retrieves the "COPY toner saving range B", which has been copied from the density range managing table 53 to the RAM 43, and replaces the "COPY toner saving range A", which is stored in the density range storage 58 with the "COPY toner saving range B." Thereafter, the process executes steps S14 onwards, where the print density is set within the toner saving range B, and printing is executed.

Incidentally, the print program 83 for the copier/facsimile is similar to the print program 52 for the copier/facsimile of the first embodiment except that S17 is replaced with S51 of the print program 82. Since S51 is described above, description and flowchart of the print program 82 are omitted for brevity.

According to MFP 1B of the third embodiment, since the toner amount is predicted based on the Coverage accumulated value which represents the amount of actual printing on the printing sheets, even if detection precision of the toner detect module 30 is relatively low, prediction accuracy of the remaining amount of the toner can be improved.

It should be noted that, although three exemplary embodiments have been described, the invention need not be limited to the described embodiments, and various modifications may be possible within the scope of the invention. Some exemplary modifications will be indicated below.

In the above embodiments, the MFP is described as an example of the "printing device." However, the "printing device" need not be limited to the MFPs, and a printer which has only a printer function, a copier which has only a copier function, a facsimile device which has only a facsimile function, etc., may be regarded as the printing device to which the present invention can be applied.

In the above-described embodiments, the density range managing table 53 stores different values of the normal range for the copying function, and the printer function. However, the values of the normal range may be the same.

In the above-described embodiments, the density range managing table 53 is configured such that the values defining the normal range for the facsimile function and the copier function are the same, and the maximum values of the toner saving ranges A and B for the facsimile function are different from the maximum values of toner saving ranges A and B of the copier function. This configuration may be modified such that the values defining the normal range of the facsimile function are different from those for the copier function, and the maximum values of the toner saving ranges A and B for the facsimile function are the same as the maximum values of the toner saving ranges A and B for the copier function, respectively.

The maximum value of the "COPY toner saving range A" in the density range managing table 53 may be greater than the maximum value of the "print toner saving range A" and the maximum value of the "FAX toner saving range A." Even if the remaining toner amount is relatively small, by configuring the density range as above, if the contrast of the original document to be scanned is relatively low, the user can set a relatively high print density when copying is executed, and a printout as desired by the user can be obtained.

The "first prescribed amount" and the "second prescribed amount" may be detected in accordance with any method. That is, the "first prescribed amount" and the "second prescribed amount" may be detected with the same detection method, or the "first prescribed amount" and the "second prescribed amount" may be detected by separate detection methods. For example, in the above-described embodiments, the toner amount is detected with the toner detect module 30 employing an optical sensor. However, the toner amount may be detected with a weight sensor.

In the above-described embodiments, when the printer function is selected, the printing program 51 shown in FIG. 6 is executed, and when the facsimile function is selected, the printing program 52 shown in FIG. 52 is executed to lower the maximum value of the density range, thereby saving consumption of the toner. FIG. 12 shows a modification regarding limitation of the maximum value of the density range. In the print process shown in FIG. 12, a case where the scanned data, which is generated as the image scanning module 3 scans the original document, is printed, and a case where the image data acquired via the interface 45 is printed are distinguished (S61), and the maximum value of the density range is limited only when the acquired image data is printed. When the scanned data is printed, since printing results are dependent on the image formed on the original document, there may be cases where it is not appropriate to limit the maximum value of the density range uniformly. On the contrary, since image data is acquired directly from the external device such as the PC 61, the printing results are not influenced by the external factors. Thus, when the image data is printed, the maximum value of the density range may be limited uniformly. According to the above configuration, the maximum value of the density range can be adjusted appropriately with taking the effects of external factors into account. Optionally, the above-described modification of the printing program may be applied to a case where the image data is retrieved from the external memory connected to the printing device is printed as well as the case where the print request is received from the external device (e.g., the PC 61).

In the above-described embodiments, whether the toner becomes less than the second prescribed amount is detected based on the number of printed sheets or the Coverage accumulation value. If accuracy is sufficiently high, whether the amount of the toner is equal to or less than the second prescribed value may be detected based on a value measured by the toner detect module 30 or the weight sensor.

In the above-described embodiments, the toner is explained as an example of printing material. It should be noted that the present invention is applicable in a case where other material such as ink is used as the printing material.

What is claimed is:

1. A printing device comprising:

a printing module which executes printing of a print data instructed to be printed on a printing medium using printing material with a set print density;

an amount detecting module which detects a remaining amount of the printing material;

a first value determining module configured to determine a maximum value of a density range within which a print density is to be set for printing, wherein if the amount detecting module detects that the remaining amount of the printing material is equal to or less than a predetermined amount, the maximum value is determined to be a value smaller than a maximum value of the density range for a case where the remaining amount of the printing material is larger than the predetermined amount;

a density judging module configured to judge whether a print density currently set for printing of the print data is greater than the maximum value determined by the first value determining module; and a print density changing module configured to change the currently set print density for printing to be equal to or less than the maximum value determined by the first value determining module if the density judging module judges that the currently set print density for printing is greater than the maximum value determined by the first value determining module, wherein the printing module executes printing of the print data with the changed set print density changed by the print density changing module.

2. The printing device according to claim 1, wherein the amount detecting module includes:

a first amount detector configured to detect whether the remaining amount of the printing material is a first predetermined amount; and a second amount detector configured to detect whether the remaining amount of the printing material is a second predetermined amount that is less than the first predetermined amount, and wherein the first value determining module changes the maximum value of the density range to a first value if the remaining amount of the printing material is equal to or less than the first predetermined amount, the first value determining module further changing the maximum value of the density range to a second value if the remaining amount of the printing material is equal to or less than the second predetermined amount.

3. The printing device according to claim 2, wherein the print density changing module allows a user to change an initial setting value of the print density, wherein the first value determining module uses the initial setting value as the second value.

4. The printing device according to claim 2, further comprising a quantity calculating module which calculates a quantity of images having been formed on the printing medium, wherein the second amount detector determines that the remaining amount is the second predetermined amount when a predetermined quantity of images has been formed on the printing medium after the remaining amount of the printing material was detected to be the first predetermined amount by the first amount detector.

5. The printing device according to claim 4, wherein the quantity calculating module includes a sheet counting module configured to accumulatively count a number of sheets of the printing medium on which the images have been formed, and wherein the second amount detector detects that the predetermined quantity of images has been formed if the number of sheets accumulatively counted by the sheet counting module reaches a predetermined number.

6. The printing device according to claim 4, wherein the quantity calculating module includes a coverage calculating module configured to accumulatively count a coverage representing a ratio of an amount of printed letters/images on the printing medium to an amount of printed letters/images assumed to be fully formed on the printing medium, and wherein the second amount detector detects that the predetermined quantity of images has been formed if the coverage accumulatively counted by the coverage calculating module reaches a predetermined value.

7. The printing device according to claim 1, further comprising:

a scanning module configured to scan an original document;

a data acquiring module configured to acquire data from an external source;

a data source determining module configured to determine whether data subject to printing is data scanned by the scanning module or data acquired by the data acquiring module, wherein the first value determining module functions when the data source determining module determines the data subject to printing is the data acquired by the data acquiring module, and wherein the first value determining module does not function when the data source determining module determines the data subject to printing is the data scanned by the scanning module.

8. The printing device according to claim 1, which is operable in one of a first mode where printing is executed with saving the printing material and a second mode where quality of an image is given priority over saving of the printing material, wherein the first value determining module functions when the first mode is selected as the operation mode of the printing device, and wherein the first value determining module does not function when the second mode is selected as the operation mode of the printing device.

9. The printing device according to claim 8, further comprising a mode selection module which is operable by a user and allows the user to select one of the first mode and the second mode.

10. The printing device according to claim 8, further comprising a second value determining module which is configured to determine the minimum value of the density range for the second mode to be a value greater than a minimum value of the density range for the first mode if the printing device operates in the second mode, wherein the density judging module judges whether a print density currently set for printing of the print data is smaller than the minimum value of the density range determined by the second value determining module, and wherein, if the density judging module judges that the set-print density currently set for printing of the print data is smaller than the minimum value of the density range determined by the second value determining module, the print density change module changes the print density value currently set for printing of the print data to a value equal to or greater than the minimum value determined by the second value determining module.

11. The printing device according to claim 1, further comprising a notification module configured to notify a user that the set-density range currently set for printing of the print data is to be changed.

12. The printing device according to claim 11, wherein, when the print density currently set for printing of the print data is to be changed, the notification module notifies the user of the maximum value determined by the first value determining module and that the print density currently set for printing of the print data has been changed.

13. The printing device according to claim 1, wherein the print module is configured to execute printing using a plurality of colors of the printing material, wherein the amount detecting module is configured to detect the remaining amount of each of the plurality of colors of the printing material, and wherein, if the amount detecting module detects that the remaining amount of at least one of the plurality of colors of the printing material is equal to or less than a predetermined amount, the maximum value of a density range to be a smaller value than a maximum value of the density range for a case where the remaining amount of the printing material is greater than the predetermined amount.

14. A method of determining a print density of images formed by a printing device which executes printing of a print data instructed to be printed on a printing medium using printing material with a set print density, the method comprising the steps of:

detecting a remaining amount of the printing material;

first determining a maximum value of a density range within which the print density is to be set for printing, wherein if the step of detecting detects that the remaining amount of the printing material is equal to or less than a predetermined amount, the maximum value is determined to be a value smaller than a maximum value of the density range for a case where the remaining amount of the printing material is larger than the predetermined amount;

judging whether a print density currently set for printing of the print data is greater than the maximum value determined by the step of the first determining; and changing the currently set print density for printing to be a print density equal to or less than the maximum value determined by the step of the first determining if the step of judging judges that the currently set print density for printing is greater than the maximum value determined by the step of the first determining, wherein the printing device is configured to execute printing of the print data with the changed set print density changed in the step of changing.

15. The method according to claim 14, wherein the printing device is provided with a scanning module configured to scan an original document, and a data acquiring module configured to acquire data from an external source, and wherein the method further comprising the steps of:

determining whether data subject to printing is data scanned by the scanning module or data acquired by the data acquiring module, and wherein the first determining functions only when the data subject to printing is the data acquired by the data acquiring module.

16. The method according to claim 14, further comprising a step of notifying a user that the density range currently set for printing of the print data is to be changed.

17. The method according to claim 14, wherein the printing device is configured to execute printing using a plurality of colors of the printing material, wherein the step of detecting the remaining amount detects the amount of each of the plurality of colors of the printing material, and wherein, if the step of detecting detects that the remaining amount of at least one of the plurality of colors of the printing material is equal to or less than a predetermined amount, the maximum value of a density range is determined to be a smaller value than a maximum value of the density range for a case where the remaining amount of the printing material is greater than the predetermined amount.

18. A computer-accessible recording medium storing a program to be executed by a computer provided to a printing device, the program including instructions that cause the computer to function as:

a printing module which executes printing of a print data instructed to be printed on a printing medium using printing material with a set print density;

an amount detecting module which detects a remaining amount of the printing material;

a first value determining module configured to determine a maximum value of a density range; within which a print density is to be set for printing, wherein if the amount detecting module detects that the remaining amount of the printing material is equal to or less than a predetermined amount, the maximum value is determined to be a value smaller than a maximum value of the density range for a case where the remaining amount of the printing material is larger than the predetermined amount;

a density judging module configured to judge whether a print density currently set for printing of the print data is greater than the maximum value determined by the first value determining module; and a print density changing module configured to change the currently set print density for printing to be equal to or less than the maximum value determined by the first value determining module if the density judging a module judges that the currently set print density for printing is greater than the maximum value determined by the first value determining module, wherein the printing module executes printing of the print data with the changed set print density changed by the print density changing module.

19. The computer-accessible recording medium according to claim 18, wherein the printing device is provided with a scanning module configured to scan an original document and a data acquiring module configured to acquire data from an external source, wherein the program further includes instructions that cause the computer to function as a data source determining module configured to determine whether data subject to printing is data scanned by the scanning module or data acquired by the data acquiring module, and wherein the first value determining module functions only when the data source determining module determines the data subject to printing is the data acquired by the data acquiring module.

20. The computer-accessible recording medium according to claim 18, wherein the printing device is configured to execute printing using a plurality of colors of the printing material, wherein the amount detecting module is configured to detect the remaining amount of each of the plurality of colors of the printing material, and wherein, if the amount detecting module detects that the remaining amount of at least one of the plurality of colors of the printing material is equal to or less than a predetermined amount, the maximum value of a density range to be a smaller value than a maximum value of the density range for a case where the remaining amount of the printing material is greater than the predetermined amount.

* * * * *

UNITED STATES PATENT AND TRADEMARK OFFICE

CERTIFICATE OF CORRECTION

PATENT NO. : 7,738,800 B2
APPLICATION NO. : 11/949802
DATED : June 15, 2010
INVENTOR(S) : Akihiro Yamada It is certified that error appears in the above-identified patent and that said Letters Patent is hereby corrected as shown below:

In Column 19, Claim 10, Line 32:
Please remove "set-print density" and insert --print density--.

In Column 19, Claim 11, Line 41:
Please remove "set-density range" and insert --density range--.

In Column 20, Claim 18, Line 62:
Please remove "range; within" and insert --range within--.

Signed and Sealed this
Fifteenth Day of February, 2011

David J. Kappos

David J. Kappos
*Director of the United States Patent and Trademark Office*